United States Patent [19]

Giasi

[11] Patent Number: 4,856,708

[45] Date of Patent: Aug. 15, 1989

[54] ADHESIVELY SECURED CONTAINER COVER

[76] Inventor: Joseph Giasi, 20 W. Park Ave., Long Beach, N.Y. 11561

[21] Appl. No.: 247,721

[22] Filed: Sep. 22, 1988

[51] Int. Cl.[4] ..... B65D 53/00

[52] U.S. Cl. ..... 229/125.17; 220/359; 229/125.35

[58] Field of Search ..... 229/125.35, 5.5, 125.17; 220/359; 215/232

[56] References Cited

U.S. PATENT DOCUMENTS 3,424,343 1/1969 Hoeffelman ..... 229/5.5 X
3,455,500 7/1969 Wilcox ..... 229/125.17
4,044,941 8/1977 Knudsen ..... 229/125.35 X
4,141,463 2/1979 Smith ..... 229/125.35 X

FOREIGN PATENT DOCUMENTS 659091 3/1963 Canada ..... 220/359

*Primary Examiner*—Donald F. Norton
*Attorney, Agent, or Firm*—Myron Amer

[57] ABSTRACT

A cover adhesively secured over the edge of a product container in which strategically located overlapping lips on the cover and product container edge minimize any loss of adhesive during their being bonded together.

4 Claims, 3 Drawing Sheets

ADHESIVELY SECURED CONTAINER COVER

The present invention relates generally to covers or closures for the top openings of cylindrical cardboard containers which are adhesively secured over these top openings to provide a hermetic seal for the container contents.

The adhesively secured cover is constructed for ready removal of its medial portion, usually by using a ring that removes a tear strip about the medial portion, such that the resulting opening thereafter provides access to the container contents. An adhesively secured cover for a container as described is, of course, already known and in use, but these prior art covers do not embody structural features of the within inventive cover which facilitate their adhesive attachment to the container.

More particularly, and as will be described in greater detail subsequently herein, what distinguishes the inventive cover over the prior art is the provision thereon of a downturned peripheral wall which, according to the invention, is itself provided with a radically inwardly oriented flap. On the upper edge of the cylindrical container bounding the opening into the container is a radically outwardly oriented flap. When the cover is placed on the container, there is a compartment formed in the upper area on the inside of the cover peripheral wall, and the two noted flaps overlap each other and form a seal or closure for the compartment.

In practice, an adhesive is placed in the compartment and achieves an adhesive attachment between the cover and cylinder effective to provide a vacuum or hermetic seal. An important aspect of the invention is that the seal or closure provided by the overlapping flaps prevents inadvertent exiting flow of the adhesive from the compartment while the adhesive is curing.

EXAMPLES OF PRIOR ART

U.S. Pat. No. 2,445,647 issued on July 20, 1948 to THOMAS discloses in FIG. 4 a gasket 6 which is cemented in the corner 7 of a cover or lid 3, and the lid 3 is then snapped over the container opening so that configuration 5 on the lid slips beneath the container lug 9. The overlapping structures 5 and 9 must be acknowledged as being superficially similar to the proposed overlapping flaps, but the gasket, of course, is not an adhesive. Additionally, it is noted, as at col. 3, in line 2, that the gasket is cemented in place before the lid is placed on the container so that unlike the inventive overlapping flaps, the THOMAS structures 5 and 9 do not assist in minimizing loss of the adhesive prior to the curing thereof.

U.S. Pat. No. 4,583,656 issued on Apr. 22, 1986 to MACLAUGHLIN is noted because it discloses the use of an adhesive 41 to seal the closure, in this case a foil 43, over the opening of a container 10. Rather than using overlapping flaps, however, MACLAUGHLIN provides a compartment for the adhesive in the form of a flat 26 in the construction of the upper end of the container; and, thus, uses an entirely different approach to the problem.

The improvement over prior art adhesively secured container covers and lids achieved by this invention is the embodiment in the inventive cover of an inwardly extending lip or flap strategically located so as to cooperate with an outwardly extending lip or flap in the construction of the upper edge of the container so that the overlapped relation of these lips serves as a closure for a compartment into which the adhesive is placed incident to adhesively securing the cover to the container; said closure thusly formed for the adhesive-containing compartment minimizing the loss of adhesive prior to the curing thereof, and also providing a mechanical attachment, in addition to the adhesive attachment, between the cover and the container.

The description of the invention which follows, together with the accompanying drawings should not be construed as limiting the invention to the examples shown and described, because those skilled in the art to which this invention appertains will be able to devise other forms thereof within the ambit of the appended claims.

Figure 1:
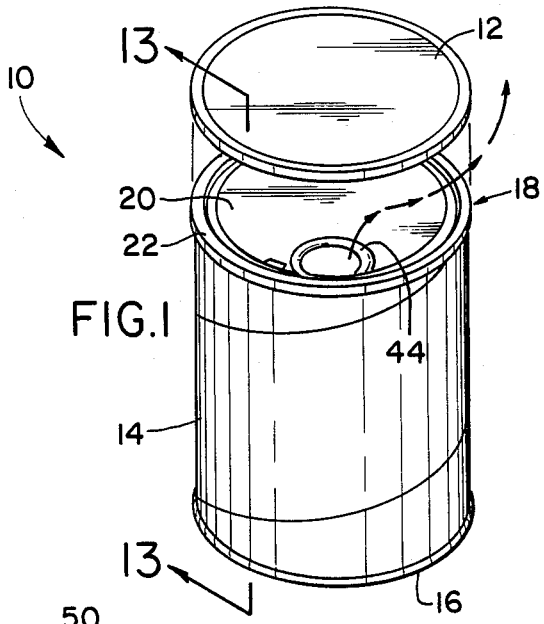
FIG. 1 is a perspective view of a container having a cover adhesively secured as a closure over the top opening thereof in accordance with the present invention.
Figure 13:
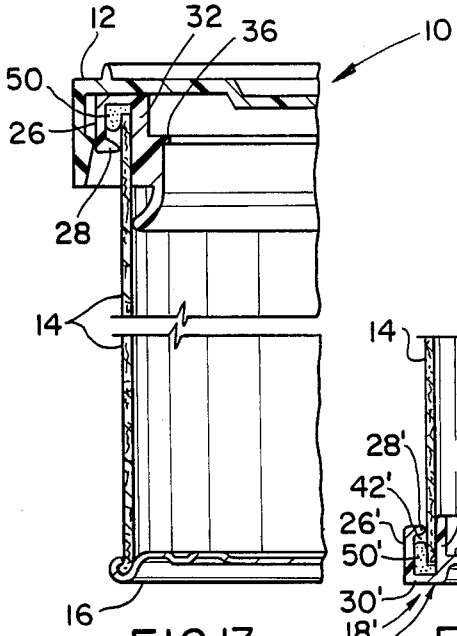
Figure 13:
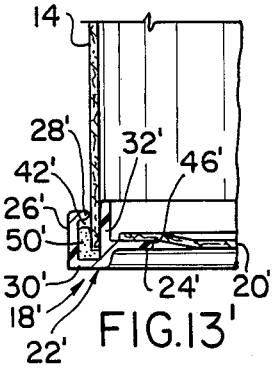
Figure 4:
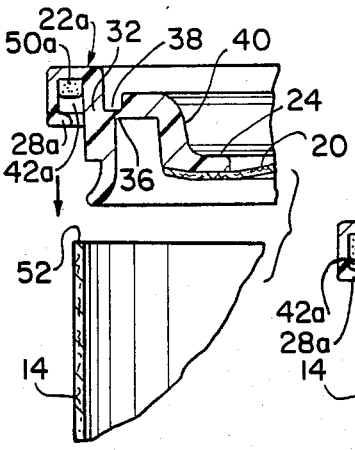
Figure 4:
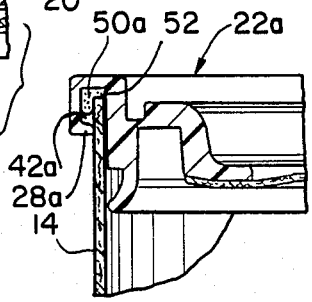
Figure 5:
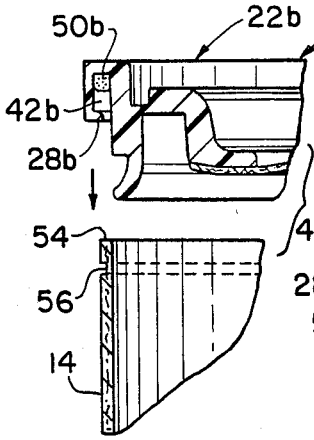
Figure 5:
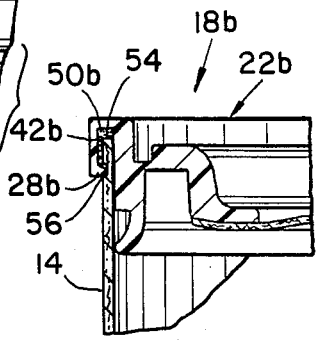
Figure 6:
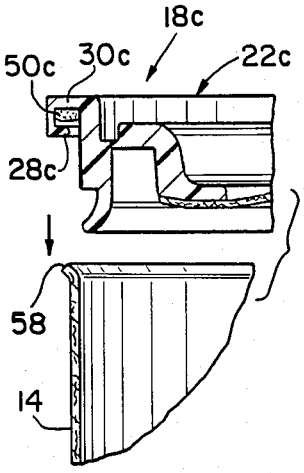
Figure 6:
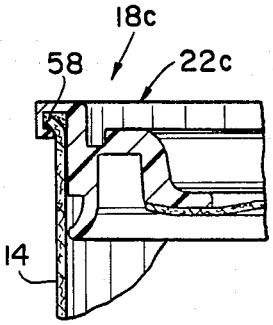
Figure 7:
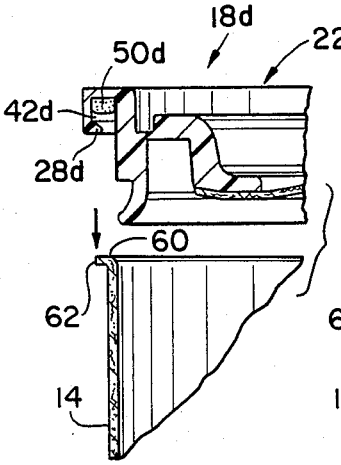
Figure 7:
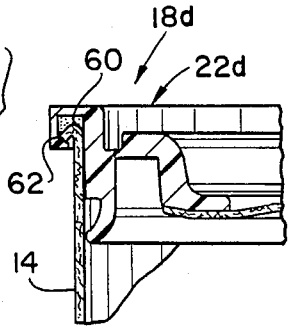

FIGS. 4–12 and 4'–12' are companion figures, in which the inventive cover in FIGS. 4–12 is shown preparatory to being adhesively secured to a cooperating container, and in FIGS. 4'–12' is shown in its adhesively attached condition. Further, in these figures the cover is shown in relation to varying constructions of the edge of the container bounding the top opening thereof wherein, more particularly, said figures are of the following;

FIGS. 4 and 4' are partial sectional views respectively showing the cover being applied to a first embodiment of a container edge;

FIGS. 5 and 5' are similar to FIGS. 4 and 4', but of a second embodiment of a container edge;

FIGS. 6 and 6' are also similar to FIGS. 4 and 4', but of a third embodiment of a container edge;

FIGS. 7 and 7', 8 and 8', 9 and 9', 10 and 10', 11 and 11', and 12 and 12', are all similar to FIGS. 4 and 4', but said figures are respectively of a fourth, fifth, sixth, seventh, eighth, and ninth embodiment of a container edge;

FIG. 13 is a side elevational view of the inventive cover of FIG. 1, taken in section along lines 13—13 of FIG. 1, showing further details; and FIG. 13' is a partial sectional view similar to FIG. 13, but of another embodiment of a bottom opening closure for the container.

Shown in FIG. 1 is a cylindrical container 10 typically supplied with an auxiliary cover 12 to be used as a closure for the top opening of the container when the factory-supplied adhesively secured cover 20 is removed to obtain access to the contents of the container. The illustrated container 10 will be understood to be the type manufactured with a 2-ply, spiral paper wall 14, a bottom closure member 16 and a container top opening seal sub-assembly 18. Seal assembly 18 is comprised of a paper disc 20 bonded within a plastic ring 22. Exterior paper surfaces of either or both of the cover and wall of the container 10 may typically have advertising and product data printed thereon, as well as surface processing to render the paper impervious to air and moisture. Interior paper surfaces may be treated as well with plastic coating or foil to minimize interaction with the container contents.

Figure 3:
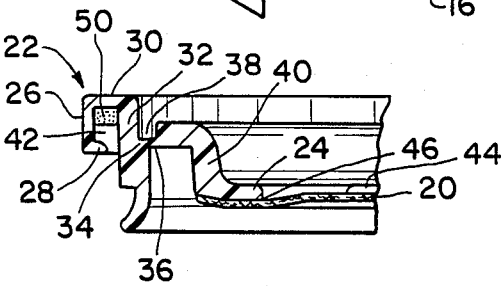
FIG. 3 is a side elevational view of the cover, in section taken along line 3—3 of FIG. 2.

Of particular interest in this invention is the manner in which the top seal is constructed and hermetically connected to the upper edge or lip of wall 14. The sectional view in FIG. 3 will now be used as reference for a detailed explanation of this top seal.

Paper disc 20, cut to appropriate diameter, is conventionally bonded to the lower face of inner flange 24 of plastic ring 22 at the Juncture 46. Ring 22 is comprised of an outer, somewhat flexible, vertical wall 26 at whose base is an inwardly extending lip 28. An upper horizontal wall 30 extends to a second vertical wall 32 of varying thickness. Walls 26, 30 and 32 cooperate to bound an annular cavity 42. Adjacent shoulder-like extension 34 is a relatively thin wall 36 which is formed at the base of groove 38 and is connected to the offset wall 40 of flange 24.

Prior to assembly of a top seal assembly 18 to a container wall 14, annular cavity 42 is partially filled with a tacky, rubbery adhesive 50, preferably of the type which bonds in response to pressure and is so-called "pressure sensitive". Pressure sensitive adhesive 50 is selected to provide an adhesive bond between plastic and cardboard and then to bond the plastic ring 22 to the cardboard container wall 14. One such adhesive 50 is supplied by Dewey and Almay Chemical division of W. R. Grace and Co., Lexington, Me. 02173 and is sold commercially as DAREX sealing compound SLC 9179 AHV. In a well understood manner an appropriate amount of DAREX sealing powder is diluted with an appropriate solvent to a viscosity of 1150 centipoise at 36% total solids and, in practice, provides an effective hermetic seal of cover 20 for the container 10.

Figure 2:
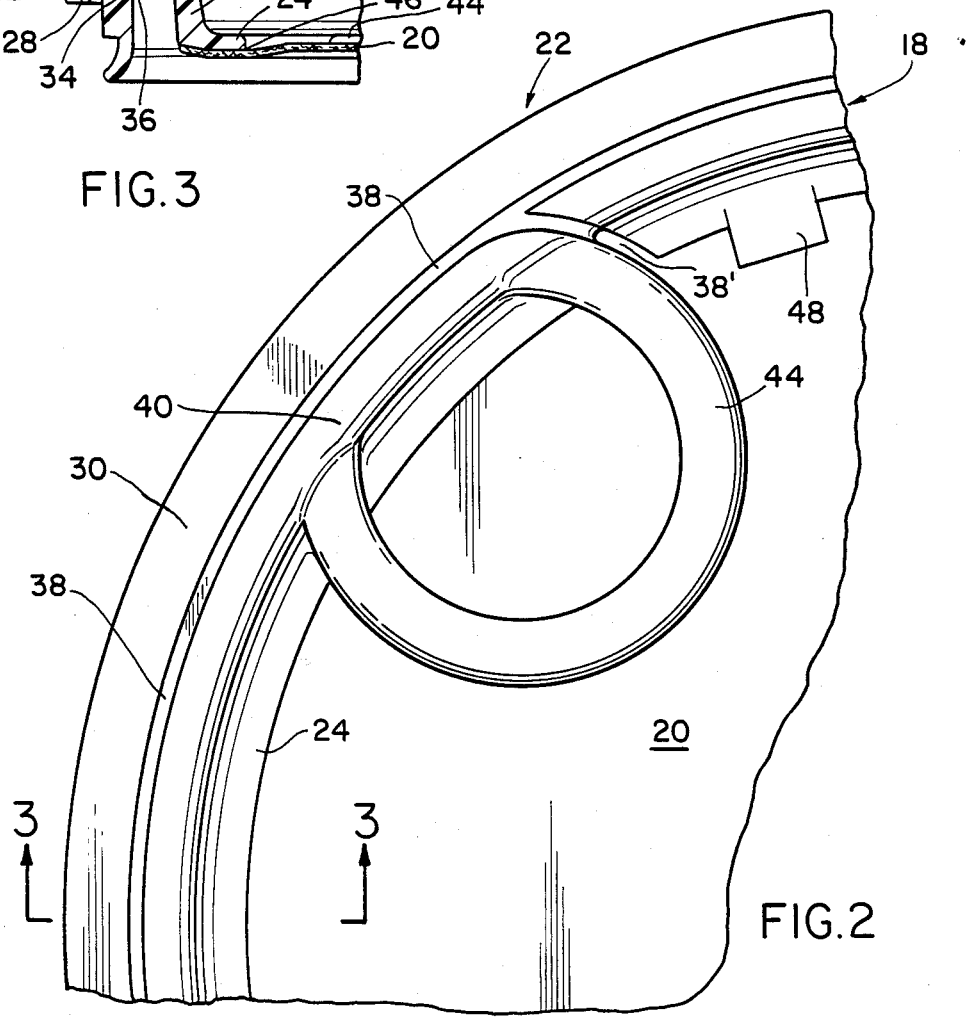
FIG. 2 is a partial plan view, on an enlarged scale, showing further structural details of the inventive cover.

As seen in FIG. 2, a finger grip 44 is provided on seal assembly 18 whereby access to the contents of container 10 can be readily made available. The user, after setting aside auxiliary cover 12 for later use, will preliminarily grasp container 10 in one hand and grasp gripping ring 44 with the other hand. A lead-in groove 38' cooperates with offset wall 40 and converts a portion of the latter to a tear away strip, when tension is applied to ring 44. Thin wall 36 then is readily ruptured, as is the connection between flange 24 and paper disc 20 at 46. Towards the end of the pull operation of ring 44, when the tear away point approaches the lead-in groove 38', a tab 48 fastened to disc 20 causes wall 40 and disc 20 to remain as a unit for convenient, proper disposal, as the thin wall 36 continues to yield about the circumference of annular groove 38. This action completes the opening of container 10.

From the foregoing it should be apparent that the resulting hermetic seal contemplates an interfitting of the annular cavity 42 of ring 22 about the upper, conventionally finished edge of container wall 14 and that this simply requires adjusting the dimensions of horizontal wall 30, the length of vertical wall 26 and the shape of lip 28 to achieve the proper fit between cover 20 and container 10.

FIGS. 4 through 12 show a variety of top edges of container wall 14 that can be manufactured by known equipment and primed FIGS. 4' through 12' show the cover 20 in adhesively attached condition to these varied edges. For completeness' sake these figures will now be briefly described to demonstrate how cover 20 cooperates with container edges of different configurations.

In FIG. 4, top edge 52 is shown as it exists following a simple cut through wall 14 incident to providing a cylinder approximately cut to a length suitable for the end use intended. The dimensions of cavity **42*a* are such that adhesive 50*a* is completely retained within the cavity 42*a* as edge 52 is pressed within this cavity, all as shown in FIG. 4'**.

Wall 32, wall 36, wall 40, flange 24 and disc 20 undergo no change in construction and function from that described in the above and in the examples to follow; the only change being in the configuration of the container edge.

In FIG. 5, an edge 54, which is similar to edge 52, has an added circumferential embossed recess 56 made to a depth of about half the thickness of paper wall 14. This recess 56 is intended to receive lip **28*b* on ring 22*b* when top seal 18*b* is pressed onto container wall 14. Adhesive 50*b* adheres to edge 54 and is retained within annular groove 42*b*. Lip 28*b* is made to have an inside diameter equal to or slightly smaller than the base diameter of recess 56**.

The cylinder wall 14 in FIG. 6 is to have a flat-rolled top edge 58 which is slightly flared outward. Horizontal wall **30*c* of ring 22*c* is made slightly wider than in FIG. 5 to adapt to the increased outside diameter of the flare at edge 58. FIG. 6' shows the assembly of the top seal assembly 18*c* to the edge 58 of cylinder wall 14. As in all cases described, the top edge of cylinder wall 14 adheres firmly to adhesive 50**, when held briefly under pressure.

It is also contemplated that a top edge 60 of container wall 14 be made with a flat flange 62, as seen in FIG. 7. Thus, when flange 62 is pressed within annular cavity **42*d*, flange 62 tends to bend downwardly. When properly dimensioned, flange 62 will automatically lock against lip 28*d* and, as a consequence, provide a very positive mechanical, as well as adhesive, seal between ring 22*d* and wall 14**.

Figure 8:
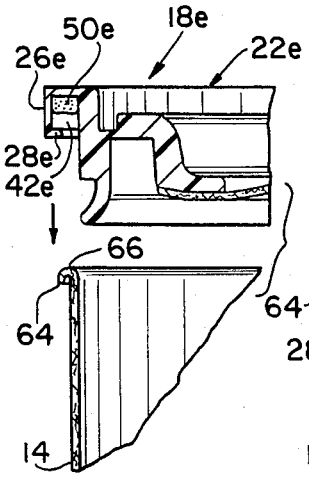
Figure 8:
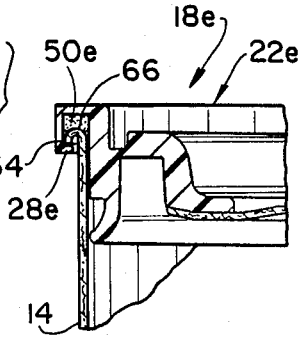

Carried a step further, the flange 62 in FIG. 7 can be "turned down" slightly in a semi-roll fashion, as is demonstrated by lip 64 in FIG. 8, to thereby form the top edge 66 of cylinder wall 14 in an appropriate configuration to mate with a cooperating reversely shaped lip **28*e* of the top seal assembly 18*e*. In seal assembly 18*e* annular cavity 42*e* in ring 22*e* is so dimensioned as to "snap over" lip 64 so that lip 28*e* assumes a gripping relation with the "turned down" lip 64 on wall 14. This condition creates a firm mechanical seal between container wall 14 and seal assembly 18*e* as shown in FIG. 8'**.

Figure 9:
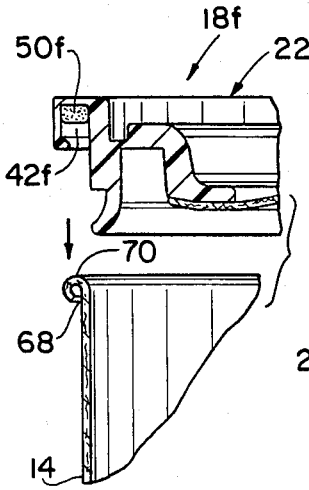
Figure 9:
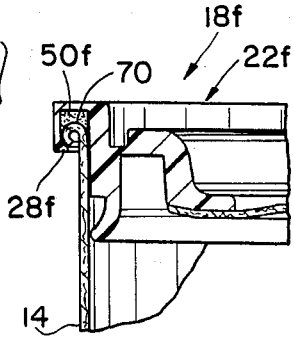

A very common rolled edge is shown on container wall 14 in FIG. 9. This type edge is readily adapted to fit within the properly dimensioned annular groove **42*f* of ring 22*f* as shown. Surface 70 presents (as does top edge 66 in FIG. 8) a large area of contact with adhesive 50*f***.

Figure 10:
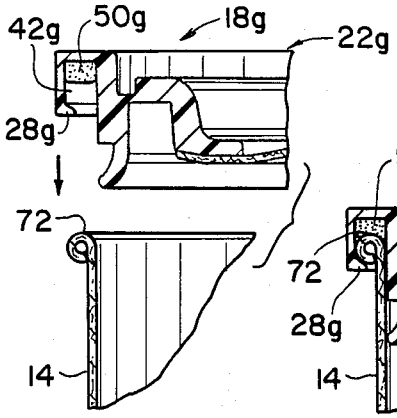
Figure 10:
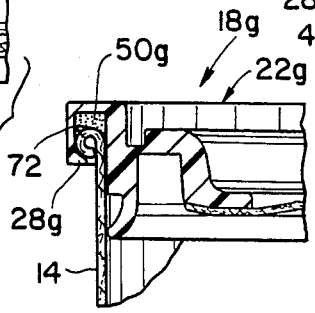

Not very different from, and also common, is the full-roll edge treatment shown in FIG. 10 in which edge 72 is turned back to wall 14. Both the full-roll edge 72 and rolled edge 68 "lock-on" to their respective rings 22 when the inside diameters of lips 28 are made purposely small. However, this mechanical locking is not as positive as those shown in FIGS. 6, 7, and 8.

Figure 11:
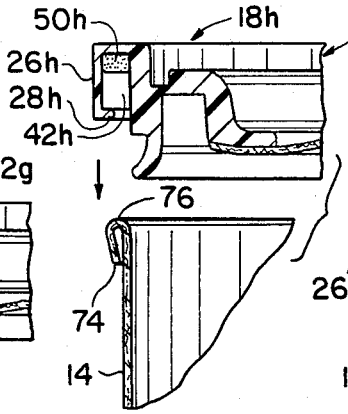
Figure 11:
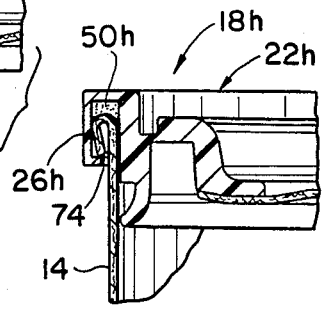

Yet another type of rolled edge is shown in FIGS. 11 and 11'. Edge 74 is bent into contact against wall 14 and adapted to present a broad surface 76 to bond with adhesive **50*h*. This configuration requires a comparative lengthening of leg 36*h* as well as an inward extension of lip 38*h***.

Figure 12:
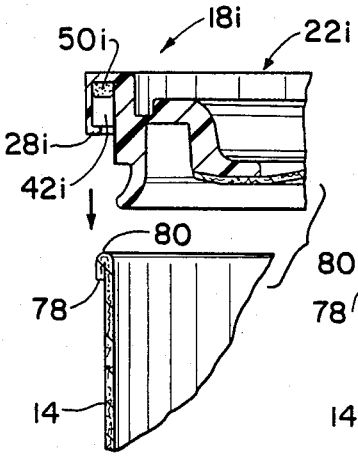
Figure 12:
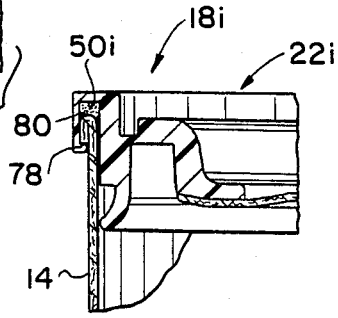

Lastly, in FIGS. 12 and 12' there is shown an edge 78 folded tightly on itself to form surface 80. Because this configuration of the top edge of container wall 14 presents a "solid profile", it is necessary to have a precise volume of adhesive 50*i* within annular groove 42*i*. Lip 28*i* is thus of a selected dimension to "lock" on edge 78, as in the previously described examples.

FIG. 13 shows a typical section through the container wall 14. At the upper end is shown what remains on the container 10 of ring 22 after offset wall 40 has been removed along with the paper disc 20. Auxiliary cover 12 is shown in place to protect any remaining contents of the container 10. Bottom member 16 is conventionally made of metal, and by a well known technique, is attached by crimping; member 16 to wall 14. Alternately in FIG. 13' it is shown that use can be made of a bottom seal assembly 18' in which a paper disc 20' is conventionally bonded to the upper face of flange 24' on plastic ring 22, as at the juncture 46'. Ring 22' is comprised of an outer wall 26' with an inward extending lip 28', a horizontal wall 30', a second vertical wall 32' and an annular cavity 42'. Adhesive 50' is applied and used as heretofore described for the top seal assembly 18, but of course ring 22' is not constructed to provide access to the contents of the container since cover 20 is used for this purpose.

In summary, the described examples illustrate how the top edge of wall 14 can be adapted to fit within an annular cavity 42, bond with adhesive 50, and mechanically interlock with ring 22 (in all cases, except that of FIGS. 4 and 4'), while retaining the adhesive 50 within the confines of said cavity or compartment 42, as bounded by walls 26, 30, 32 and lip 28. It should also be noted that the top seal assembly 18 can be adapted to be compatible with a wide variety of rolled edge cups used for beverages and commodities such as ice cream, dairy products, popped corn, and like products.

While the particular adhesively secured container cover and attachment method herein shown and disclosed in detail is fully capable of attaining the objects and providing the advantages hereinbefore stated, it is to be understood that it is merely illustrative of the presently preferred embodiments of the invention and that no limitations are intended to the detail of construction or design herein shown other than as defined in the appended claims.

What is claimed is:

1. Improvements for a product container having an adhesively secured closure: said product container being of the type formed with a cylindrical body providing a product compartment and having an upper edge bounding an opening into said product compartment; said closure being of the type formed as a cover having about its periphery a pair of outer and inner spaced apart walls bounding a cavity for adhesive therebetween and having an operative position in which said walls are in straddling relation over said product container upper edge incident to adhesive in said cavity bonding said cover as a closure to said cylindrical body; and said improvements comprising a radially outwardly extending lip means on said product container upper edge and in overlapped relation therewith a radially inwardly extending lip means on said outer wall of said cover, whereby said overlapping lip means contribute to minimizing any loss of adhesive from said adhesive cavity during the adhesive securement of said closure to said product container.

2. The improved outwardly extending lip means on said product container upper edge as claimed in claim 1 wherein said lip means is in the specific form of a rolled edge.

3. The improved outwardly extending lip means on said product container upper edge as claimed in claim 1 wherein said lip means is in the specific form of a flared edge.

4. The improved outwardly extending lip means on said product container upper edge as claimed in claim 1 wherein said lip means is in the specific form of a semi-rolled edge.

* * * * *